US008056898B2

(12) United States Patent
Folsom et al.

(10) Patent No.: US 8,056,898 B2
(45) Date of Patent: Nov. 15, 2011

(54) PIN CONVEYOR FOR PRINTED SHEET MATERIAL AND TRANSFER UNIT

(75) Inventors: James Clyde Folsom, Sanford, ME (US); Glenn Alan Guaraldi, Kingston, NH (US); Wayne Curtis Wilson, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 385 days.

(21) Appl. No.: 12/150,526

(22) Filed: Apr. 29, 2008

(65) Prior Publication Data

US 2008/0279673 A1 Nov. 13, 2008

Related U.S. Application Data

(63) Continuation of application No. 10/704,458, filed on Nov. 7, 2003, now abandoned.

(51) Int. Cl.
*B65H 9/10* (2006.01)

(52) U.S. Cl. ..... 271/233; 271/3.24; 271/271; 271/230; 270/52.16

(58) Field of Classification Search ..... 271/3.21, 271/3.24, 268, 269, 204, 229–230, 233, 271; 270/52.14, 52.16, 52.19, 52.22, 58.29; 414/790.3, 414/498.7, 798.7; 198/717, 726
See application file for complete search history.

(56) References Cited

U.S. PATENT DOCUMENTS

| | | | | |
|---|---|---|---|---|
| 1,659,099 | A | 2/1928 | Halvorsen | |
| 1,738,323 | A | 12/1929 | Scott | |
| 2,006,294 | A | 6/1935 | Beardsley et al. | |
| 4,371,156 | A | 2/1983 | Pessina et al. | |
| 4,424,965 | A | 1/1984 | Faltin | |
| 4,511,132 | A | 4/1985 | Müller | |
| 4,736,571 | A | 4/1988 | Bucolt | |
| 4,968,017 | A | 11/1990 | Depetris | |
| 5,218,813 | A * | 6/1993 | Seidel | 53/399 |
| 5,341,735 | A | 8/1994 | Hajek | |
| 5,772,391 | A * | 6/1998 | Sjogren et al. | 414/790.9 |
| 5,836,576 | A | 11/1998 | Ebner et al. | |
| 6,161,827 | A | 12/2000 | Eugster et al. | |
| 6,189,682 | B1 | 2/2001 | Hill | |
| 6,276,201 | B1 | 8/2001 | Gette et al. | |
| 6,619,650 | B2 * | 9/2003 | Gysin et al. | 271/10.01 |
| 6,726,201 | B2 | 4/2004 | Studer | |
| 6,749,190 | B2 * | 6/2004 | Studer | 270/52.14 |
| 6,814,352 | B2 * | 11/2004 | Ramseier | 271/69 |
| 6,925,784 | B2 * | 8/2005 | Escobar et al. | 53/540 |
| 6,976,674 | B2 * | 12/2005 | Honegger | 271/204 |
| 7,588,236 | B2 * | 9/2009 | Belanger | 270/52.16 |
| 2007/0158903 | A1 * | 7/2007 | Cote et al. | 271/270 |

FOREIGN PATENT DOCUMENTS

| | | |
|---|---|---|
| DE | 32 20 805 A1 | 12/1983 |
| EP | 0 806 392 B1 | 8/2002 |
| EP | 1 243 541 A2 | 9/2002 |

* cited by examiner

*Primary Examiner* — Jeremy Severson
(74) *Attorney, Agent, or Firm* — Davidson, Davidson & Kappel, LLC

(57) ABSTRACT

A pin conveyor for printed sheet material has a chain, a plurality of pins extending from the chain to push printed sheet material, and a receipt area for the printed sheet material, the chain and pins passing through the receipt area. The receipt area has at least one of the following a non-linear cross-section with the chain and pins passing through the receipt area, an inclined transport section of the chain, or a belt contacting the printed sheet material and running at or slower than a speed of the chain. A transfer unit with an overhead conveying unit and a method for delivering printed sheet material is also provided.

20 Claims, 5 Drawing Sheets

PIN CONVEYOR FOR PRINTED SHEET MATERIAL AND TRANSFER UNIT

CROSS REFERENCE TO RELATED APPLICATIONS

This is a continuation of U.S. patent application Ser. No. 10/704,458, filed on Nov. 7, 2003.

BACKGROUND

The present invention relates generally to the graphic arts industry and more particularly to a pin conveyor and transfer unit for printed sheet material, as well as to a method for transferring printed sheet material.

After printing by a printing press, printed sheet material may be cut, folded and collected into stacks. Newspaper sections for example may be collected together. The collected sheet material is then transferred and conveyed in various manners.

For example, Heidelberger Druckmaschinen AG manufactures a gripper called the NP125 which can grip newspaper sections and can transfer them to a pin conveyor, in which the pins push the newspaper sections along a horizontal raceway with a plurality of pin chains. CMC of Italy for example manufactures a horizontal pin conveyor.

German Patent Application No. 3 220 805 also discloses a horizontal pin conveyor.

U.S. Pat. No. 6,161,827 and European Patent Document No. 0 806 392 B1 disclose a method and apparatus for collecting or gathering printed products to form final printed products. A first conveyor holds first printed products and a second conveyor transfers second printed products to the first conveyor to be collected with the first printed products. A conveying unit transfers the second products to support members of the second conveyor.

European Patent Application No. 1 243 541 discloses a sheet discharge apparatus including a pressing member for providing a wavy shape to a sheet.

BRIEF SUMMARY OF THE INVENTION

A transfer of printed sheet material to a horizontal pin conveyor via gravity can cause the printed sheet material to splay. For example, newspaper sections which are to lie directly over one another can become shingled, i.e, misregistered, within a single pin conveyor envelope, leading to improper newspaper delivery.

An object of the present invention is to provide a pin conveyor which can reduce splaying. An alternate or additional object of the present invention is to provide a pin conveyor which can improve registration of printed sheet material. Yet another additional or alternate object of the present invention is to improve transfer of printed sheet material between two conveying units.

The present invention provides a pin conveyor having a chain and a plurality of pins extending from the chain to push printed sheet material, and having a receipt area for the printed sheet material, the receipt area having a non-linear cross-section and the chain and pins passing through the receipt area. The non-linear cross section aids in increasing stiffness of the printed sheet material, and may be for example a generally W, V or U-shaped cross section. The sides of the receipt area may be for example an inclined or curved wall, or inclined rollers or belts. The sides also may aid in reducing energy of the sheet material dropped into the transport section.

An additional pin chain running parallel with the chain may also be provided.

The receipt area for example may have two side walls angled toward the chain to define the cross-section, or tapes or rollers angled toward the chain. Preferably, but not necessarily, the chain runs in a flat bottom of the cross-section.

The present invention also provides a pin conveyor having a chain and a plurality of pins extending from the chain to push printed sheet material, the chain having an inclined transport section receiving the printed sheet material. A chain as defined herein can include a belt, such as an interiorly toothed belt, and the pins can be lugs or any other structure extending perpendicularly from the chain.

The inclined transport section receiving the printed sheet material can permit reduction in splaying and aid in registration via gravity forcing the sheet material against the pins.

The inclined transport section may define a non-linear cross-section.

The inclined transport section also may include at least one belt running in the same direction as the pins. This belt can run at the same speed or at a slower speed than the pin speed. The belt prevents the product from stalling in the receipt area and reduces the impact of the pins on the product.

The present invention also provides a sheet material transfer unit comprising an overhead conveyance unit which releases the printed sheet material into the transport section of the pin conveyor. The overhead conveyance unit may be in the form of a gripper conveyor.

The present invention also provides a method for delivering printed sheet material from a gripper to a pin conveyor comprising the steps of gripping the printed sheet material with a gripper; delivering the printed sheet material in front of a pin of a pin conveyor at a receipt area; and registering the printed sheet material against the pin with the aid of at least one of the following: a non-linear cross-section in the receipt area, an inclined product path in the receipt area or a belt in the receipt area.

The printed sheet material may be a newspaper with at least two sections.

BRIEF DESCRIPTION OF THE DRAWINGS

Exemplary embodiments of the present invention are described below by reference to the following drawings, in which.

DETAILED DESCRIPTION

Figure 1:
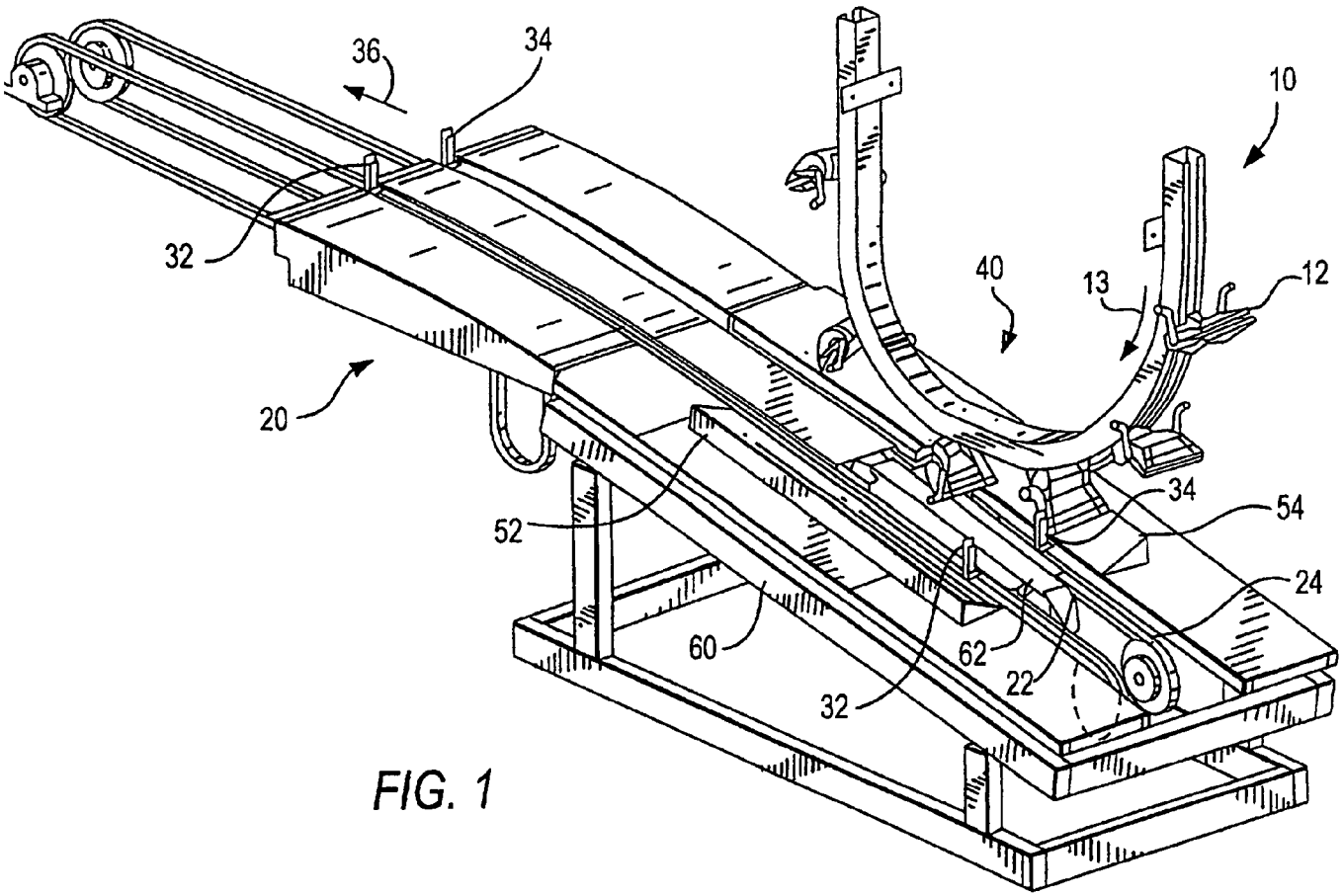
FIG. 1 shows a perspective side view of a sheet material transfer unit according to the present invention downstream from a printing press and folder.

FIG. 1 shows a gripper conveyor 10 with grippers 12 moving in direction 13 along a track. Gripper conveyor 10 passes over a pin conveyor 20. Pin conveyor 20 has two pin chains 22, 24, with pins 32, 34 respectively, moving in direction 36. In a receipt area 40 pin chains 22, 24 are inclined so that pins 32, 34 move upwardly. The angle of incline is preferably less than 45 degrees, for example 10 degrees.

At sides of the pin chains 22, 24 in the receipt area 40 are angled walls 52, 54, respectively, angled towards the chains 22, 24. These walls 52, 54 are supported on a stationary and inclined frame 60. Preferably, the incline angle of the walls 52, 54 toward the chains 22, 24 is less than 90 degrees, for example 22.5 degrees. The angled walls 52, 54 define a non-linear cross-section for the receipt area 40.

Running between the chains 22, 24 is a belt 62 running in the same direction as the pins 32, 34. Belt 62 preferably runs faster than half the speed of the pins, for example at two-thirds the speed of the pins.

Figure 2:
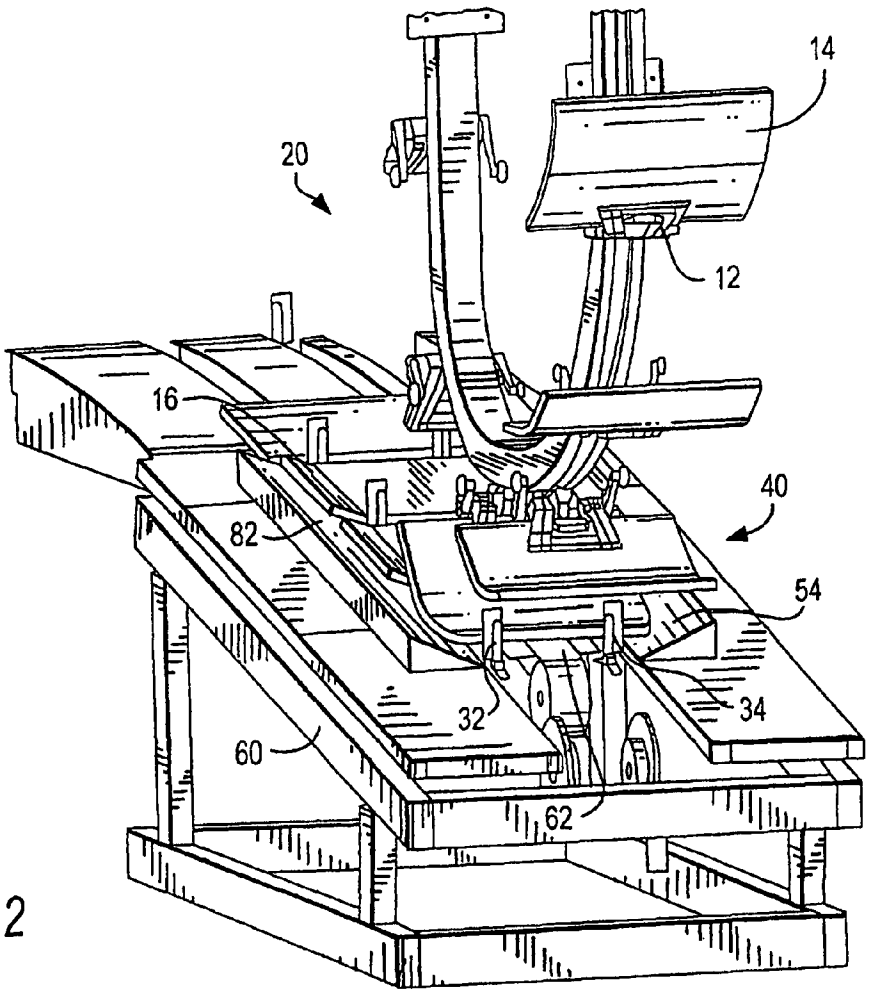
FIG. 2 shows a perspective end view of the FIG. 1 device with printed sheet material shown being transferred.
Figure 3:
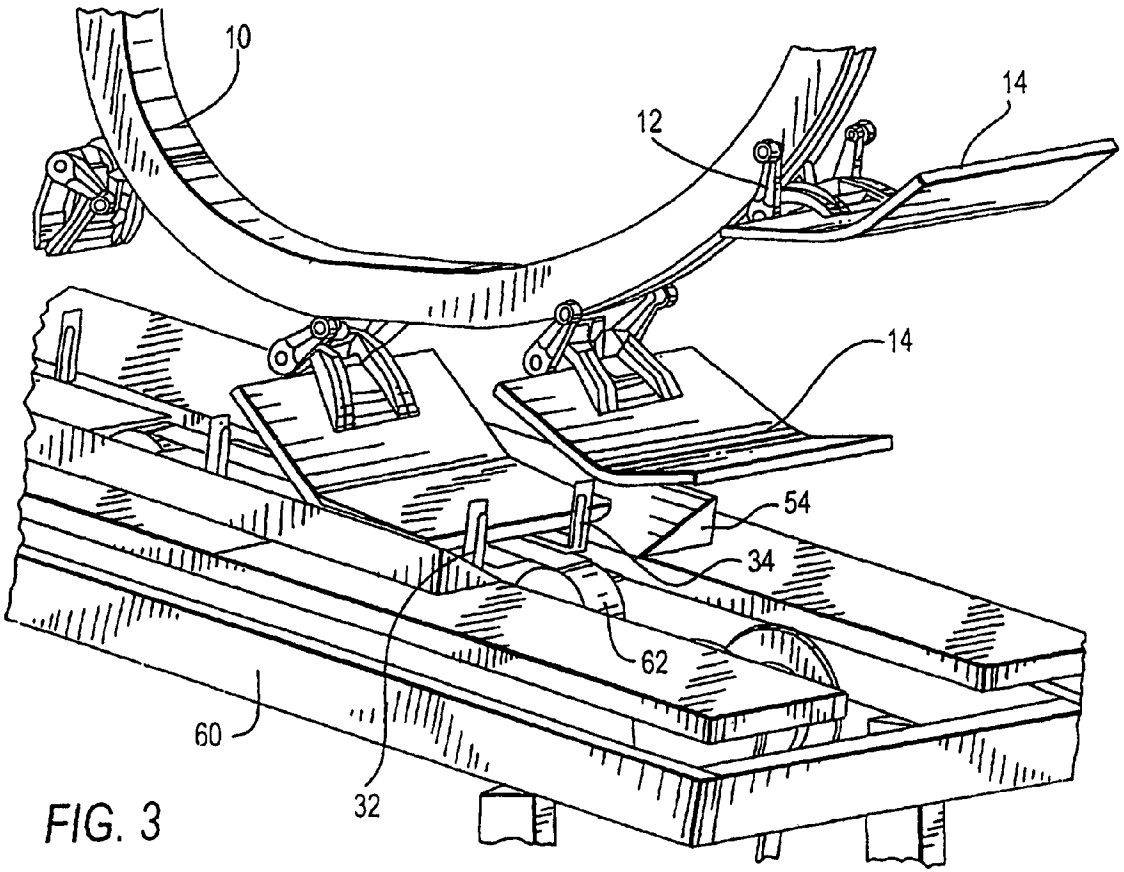
FIG. 3 shows more detail of the FIG. 1 transfer area.

FIGS. 2 and 3 show how newspaper 14, which may include two newspaper sections folded inside one another or separate and on top of one another, may be transferred by grippers 12 to pin conveyor 20. After release from grippers 12, the angled walls 52, 54 in receipt area 40 may aid in dissipating energy caused by the drop and bend the newspapers 14 at the sides 16 to increase stiffness. Gravity and belt 62 running at a slower speed than pins 32, 34 also aid in registering the newspapers against the pins 32, 34. A single item, such as a magazine, could also be dropped from the gripper and registered to the pins to facilitate alignment of the product.

Figure 4:
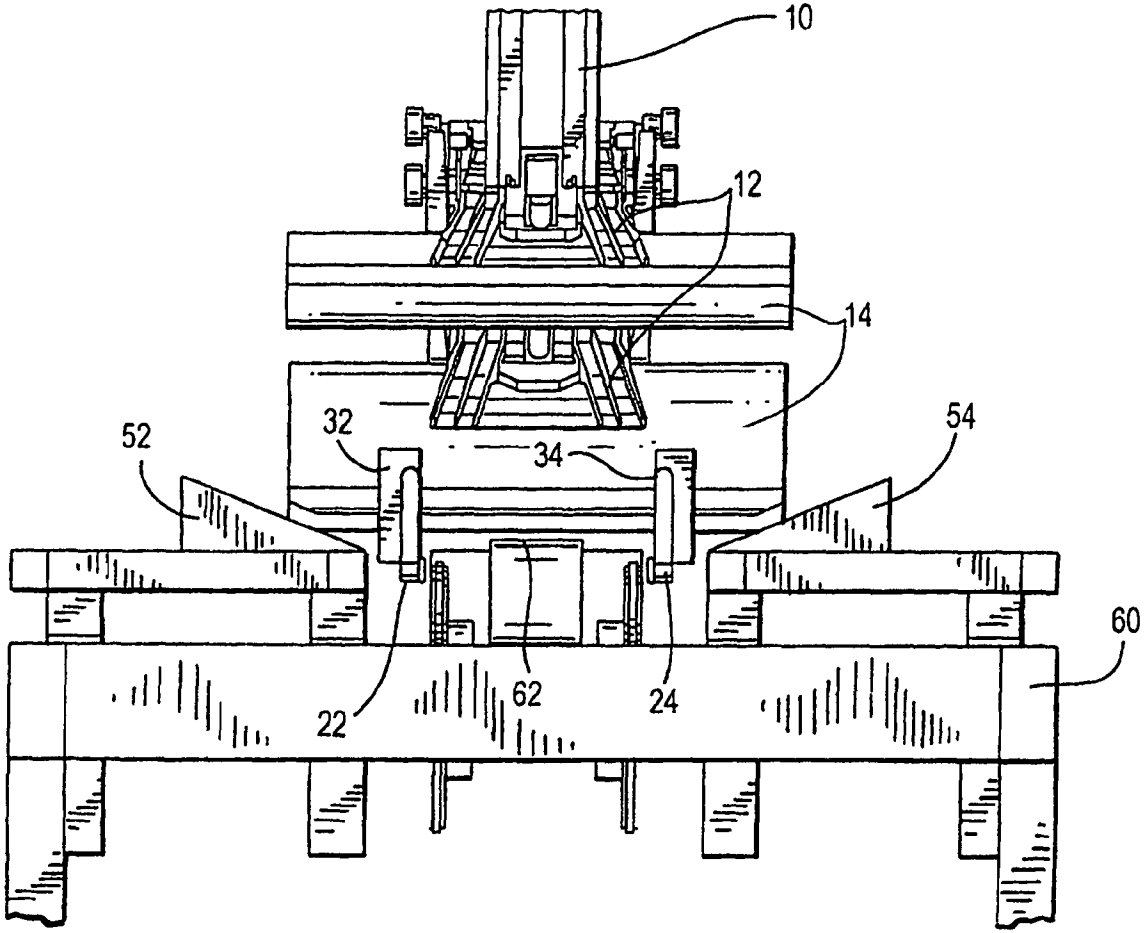
FIG. 4 shows an cross-sectional end view of the FIG. 1 device.

FIG. 4 shows a cross-sectional end view of the FIG. 1 embodiment, which shows the non-linear cross-section in the receipt area defined by walls 52, 54, the pin chains 22, 24 and belt 62.

Figure 5:
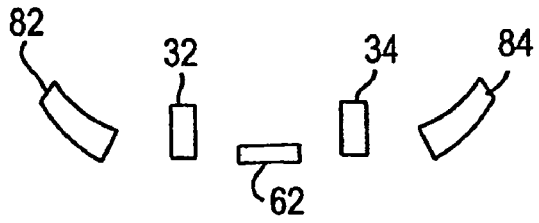
FIGS. 5, 6, 7 and 8 show cross-sections alternate to the FIG. 1 configuration.
Figure 6:
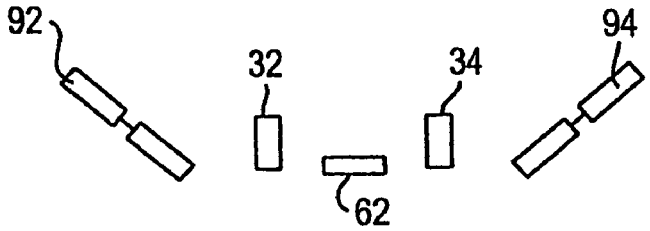
Figure 7:
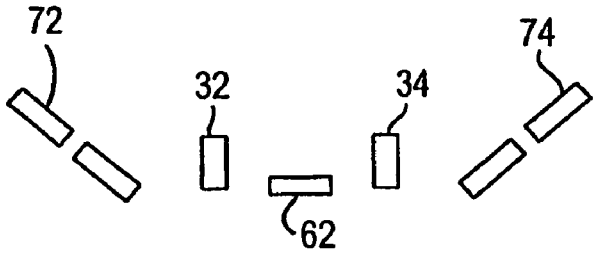
Figure 8:
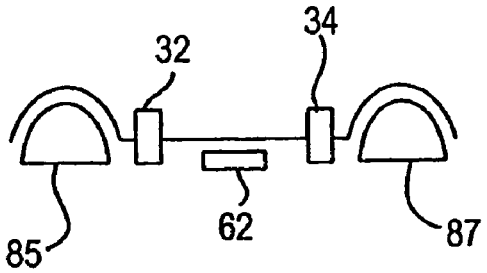

FIG. 5 shows an alternate embodiment in which the side walls 82, 84 are curved. FIG. 6 shows an alternate embodiment in which rollers 92, 94 are angled towards the pins 32, 34 in the receipt area. FIG. 7 shows another embodiment in which belts 72 and 74 run at the sides of the pins 32, 34 at an angle. FIG. 8 shows another embodiment where the side walls 85, 87 create a "W" shape in the printed product.

Other embodiments in which non-linear cross-sections in the receipt area are present are also possible. Non-linear cross-sections also are understood herein to include the case where only a single side is inclined or curved to the bottom of the receipt area.

LIST OF NUMERALS

10 gripper conveyor
12 grippers
13 direction
14 newspaper
20 pin conveyor
22 pin chain
24 pin chain
32 pin
34 pin
36 direction
40 receipt area
52 angled wall
54 angled wall
60 frame
62 belt
72 belt
74 belt
82 side wall
84 side wall
85 side wall
87 side wall
92 rollers
94 rollers

What is claimed is:

1. A method for delivering a newspaper from a gripper to a pin conveyor so as to reduce splaying comprising the steps of:

gripping a newspaper with a gripper;

transporting the newspaper in a first direction while the newspaper is gripped by the gripper;

releasing the newspaper from the gripper while traveling in the first direction so as to deliver the newspaper in front of a pin of a pin conveyor, the gripper and the pin moving in the first direction during delivery, the newspaper being released on an inclined section of the pin conveyor; and registering the newspaper against the pin using a belt, the belt moving at a slower speed than a speed of the pin.

2. The method as recited in claim 1 wherein the newspaper includes a plurality of sections.

3. The method as recited in claim 1 wherein the inclined section of the pin conveyor rises in the first direction.

4. The method as recited in claim 1 further comprising the step of transporting the newspaper with the pin in the first direction, a front flat surface of the pin contacting the newspaper.

5. The method as recited in claim 1 wherein the belt moves at a speed faster than half the speed of the pin.

6. The method as recited in claim 5 wherein the belt moves at two-thirds the speed of the pin.

7. The method as recited in claim 1 wherein the step of registering the newspaper against the pin includes using a portion of the inclined section of the pin conveyor, the portion having a non-linear cross-section.

8. The method as recited in claim 1 wherein the inclined section has an incline angle of 45 degrees or less.

9. The method as recited in claim 8 wherein the inclined section has an incline angle of 10 degrees.

10. The method as recited in claim 1 wherein the pin pushes the newspaper after delivery.

11. The method as recited in claim 1 wherein the pin conveyor is inclined so the pin moves upwardly.

12. The method as recited in claim 1 wherein the newspaper is released by the gripper onto a receipt area of the pin conveyor, the belt and the pin moving upwardly at the receipt area.

13. The method as recited in claim 12 further comprising bending the newspaper at the receipt area.

14. A method for delivering a newspaper from a gripper to a pin conveyor so as to reduce splaying comprising the steps of:

gripping a newspaper with a gripper;

transporting the newspaper in a first direction while the newspaper is gripped by the gripper;

releasing the newspaper from the gripper while traveling in the first direction so as to deliver the newspaper in front of a pin of a pin conveyor, the gripper and the pin moving in the first direction during delivery, the newspaper being released on an inclined section of the pin conveyor; and transporting the newspaper upwardly on the inclined section of the pin conveyor.

15. The method as recited in claim 14 wherein the newspaper is transported along at least one surface that bends the newspaper during the transporting the newspaper upwardly on the inclined section of the pin conveyor.

16. A method for delivering a newspaper from a gripper to a pin conveyor so as to reduce splaying comprising the steps of:

gripping a newspaper with a gripper;

transporting the newspaper in a first direction while the newspaper is gripped by the gripper by moving the gripper in the first direction;

releasing the newspaper from the gripper while traveling in the first direction so as to deliver the newspaper at a receipt area in front of a pin on a pin conveyor, the gripper and the pin moving in the first direction during delivery, the newspaper being released on an inclined section of the pin conveyor; and bending the newspaper at the receipt area with a portion of the inclined section of the pin conveyor.

17. The method recited in claim 16 wherein the portion of the inclined section that bends the newspaper has a non-linear cross-section.

18. The method as recited in claim 17 further comprising moving the newspaper along the inclined section away from the portion of the inclined section having the non-linear cross-section.

19. The method as recited in claim 16 wherein the receipt area is defined by at least one pin chain moving in the first direction, a belt moving in the first direction slower than the pin chain and two elements extending above the at least one pin chain and the belt.

20. The method as recited in claim 19 wherein the at least one pin chain and the belt are positioned between the two elements and the at least one pin chain, the belt and two elements contact the newspaper to bend the newspaper.

* * * * *